US006062380A

United States Patent [19]

Dorney

[11] Patent Number: 6,062,380

[45] Date of Patent: May 16, 2000

[54] GLOW CUP SYSTEM

[76] Inventor: Peter Dorney, 1590 Dalton Dr., Oviedo, Fla. 32765

[21] Appl. No.: 09/342,402

[22] Filed: Jun. 28, 1999

Related U.S. Application Data

[63] Continuation-in-part of application No. 09/080,150, May 18, 1998, abandoned.

[51] Int. Cl.[7] ..... B65D 77/00

[52] U.S. Cl. ..... 206/217; 206/459.1; 206/524.1; 215/6; 362/34; 362/101

[58] Field of Search ..... 206/217, 219–221, 206/457, 524.1, 524.3, 524.6, 568, 459.1, 459.5; 215/379, 382, 383.6; 220/501; 362/34, 101, 154, 266, 318, 806

[56] References Cited

U.S. PATENT DOCUMENTS

| | | | |
|---|---|---|---|
| 4,563,726 | 1/1986 | Newcomb et al. | 362/101 |
| 4,941,590 | 7/1990 | Pantaleo et al. | 206/217 |
| 5,171,081 | 12/1992 | Pita et al. | 362/34 |
| 5,769,680 | 6/1998 | Hoffman | 206/217 |
| 5,797,669 | 8/1998 | Fujita | 362/34 |
| 5,881,868 | 3/1999 | Soyak et al. | 206/217 |

*Primary Examiner*—Jacob K. Ackun
*Assistant Examiner*—Luan K. Bui

[57] ABSTRACT

A glow cup system with illumination capabilities. A container of a material which is deformable upon the application of pressure by a user's hand. The container is formed with an open top and a closed bottom and a side wall between the top and bottom. The side wall has a cylindrical wall extending from a location adjacent to the top downwardly to a location adjacent to the bottom and radially exterior of the side wall and with a circular member to form a seal at the bottom of the outer wall to totally close the space between the side wall an the outer wall. An insert of a plastic material is located within the space with an inner surface in proximity to the outer surface of the side wall. A recess is formed along one vertical extent and between the insert and a side wall. A fracturable ampule is vertically oriented within the recess and contains a first chemiluminescent fluid. A second chemiluminescent fluid is positionable within the space and is adapted to be illuminated upon the fracturing of the ampule and contact with the first chemiluminescent fluid.

16 Claims, 11 Drawing Sheets

FIG 7
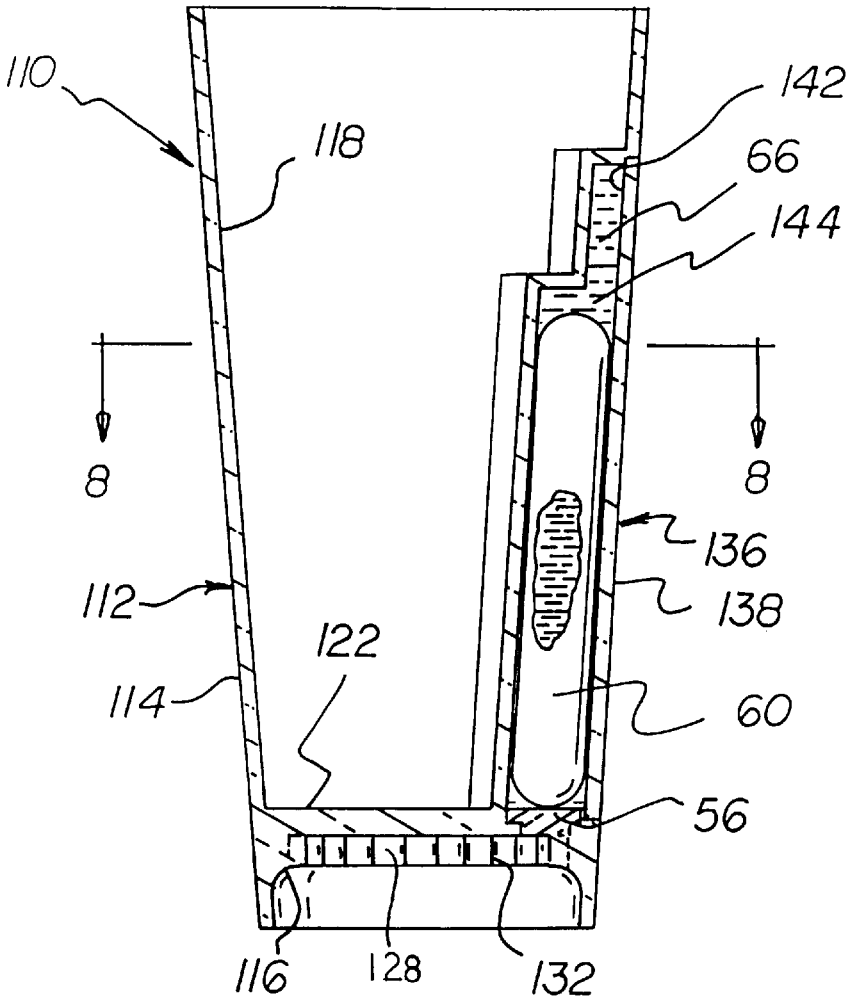
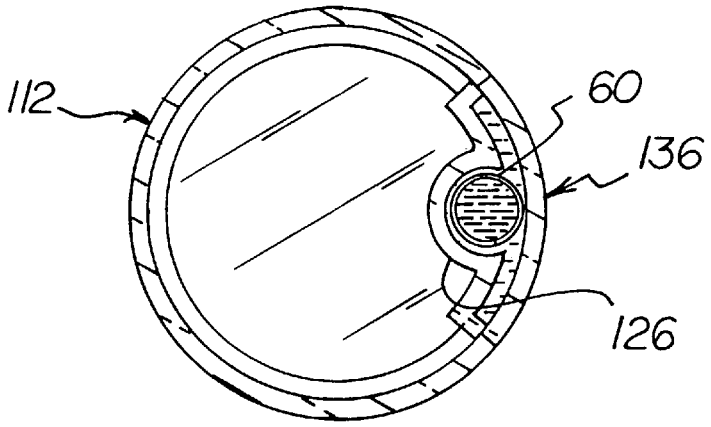
FIG 8

FIG 9
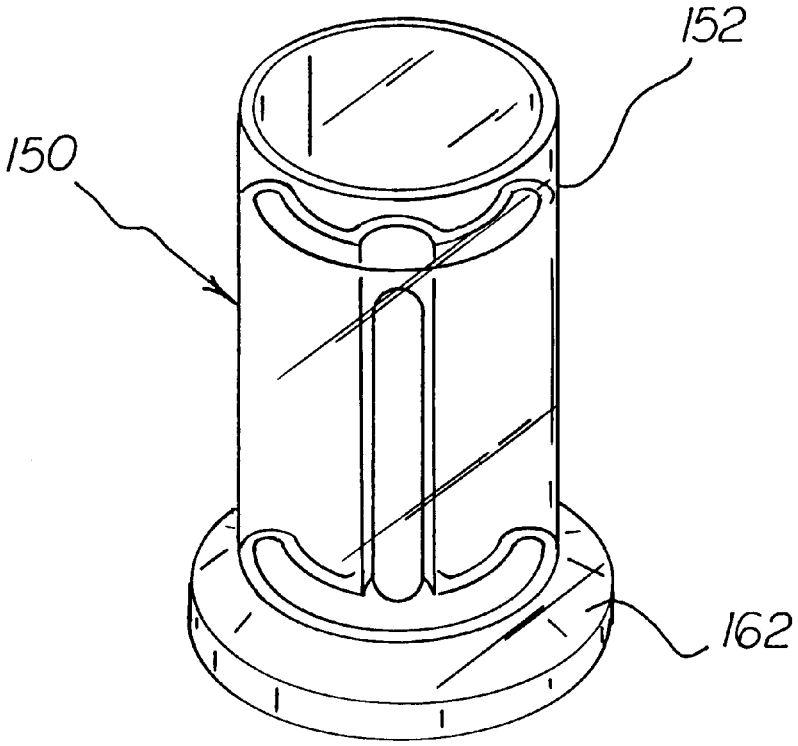
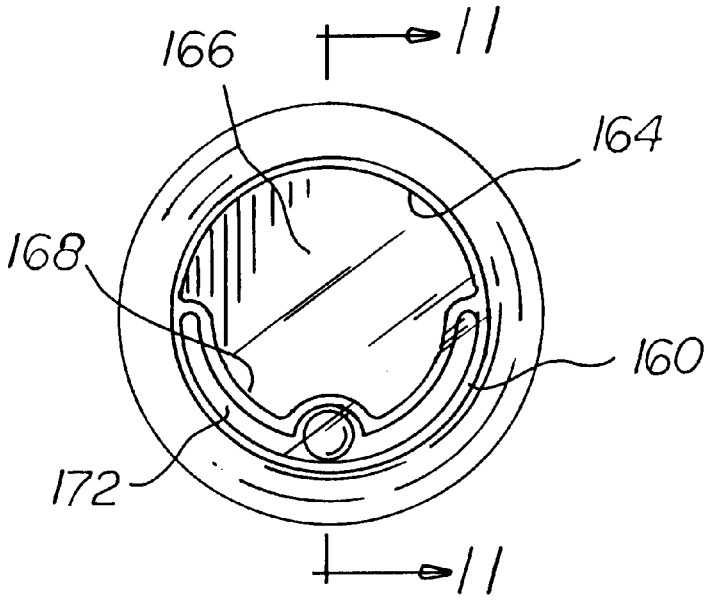
FIG 10

GLOW CUP SYSTEM

RELATED APPLICATION

The present invention is a continuation-in-part of U.S. application Ser. No. 09/080,150 filed May 18, 1998, abandoned.

BACKGROUND OF THE INVENTION

1. Field of the Invention

The present invention relates to an improved glow cup system and more particularly pertains to providing an illuminated drinking vessel and further providing a drinking vessel that can be used to open a twist off cap.

2. Description of the Prior Art

The use of an illuminated drinking vessel is known in the prior art. More specifically, illuminated drinking vessels heretofore devised and utilized for the purpose of eye pleasing effect are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,597,517 to Chopedekar, Rchleck, Guo and Hall discloses a two-composition chemiluminescent composition that is composed of an oxalate and an activator component.

U.S. Pat. No. 5,509,409 to Diehl discloses a stemmed drinking glass with an upper cup supported by a hollow stem and connected to a base that uses a chemiluminescent light stick inserted into the bellow stem to provide illumination.

U.S. Pat. No. 5,275,277 discloses a drinking glass that includes a side wall having a transparent circuitous path directed there along extending from entrance of the drinking glass to a second position in adjacency to floor portion of the drinking glass to indicate fluid level within the drinking glass structure.

U.S. Pat. No. 5,171,081 to Pita, Mershon and Muskat discloses a vessel container used in comsumption of food and/or beverage that is chemiluminescent by means of inner and outer walls and at least two compartments for containing chemiluminescent reactive substances.

U.S. Pat. No. 5,067,051 to Ladyjensky discloses a chemiluminescent lighting element comprising a tube, closed at both ends, with at least two components which are filled with liquids which produce chemiluminescent light when mixed.

U.S. Pat. No. 4,814,949 to Elliott discloses a chemiluminescent device wherein a first polymeric sheet having a shaped cavity therein is sealed around its periphery to a second polymeric sheet and the cavity contains an absorbent article being of substantially the same shape as the cavity and a sealed receptacle containing a first liquid component of a chemiluminescent light composition and outside said sealed receptacle a second liquid component of a chemiluminescent light composition.

U.S. Pat. No. 4,595,437 discloses a method of producing a warmth keeping vessel made of ceramics or porcelain.

U.S. Pat. No. 4,563,726 to Newcomb et al discloses a one-piece illuminated drinking mug with an axially disposed light permeable tube attached integrally to the bottom, said tube adapted to receive a light strip.

U.S. Pat. No. 3,372,830 to Edwards discloses a double-walled container having interfitting inner and outer receptacles or wall portions which cooperate to provide an insulated and reinforced finger gripping section of the container as well as a novel stacking construction for a double-walled container.

Lastly, U.K. Patent GB 2,122,874 to Smith discloses receptacles, etc. with relatively rotatable walls.

In this respect, the glow cup apparatus according to the present invention substantially departs from the conventional concepts and designs of the prior art, and in so doing provides an apparatus primarily developed for the purpose of an illuminated drinking vessel and further providing a drinking vessel that can be used to open a twist off cap.

Therefore, it can be appreciated that there exists a continuing need for a new and improved glow cup apparatus which can be used for an illuminated drinking vessel and further providing a drinking vessel that can be used to open a twist off cap. In this regard, the present invention substantially fulfills this need.

SUMMARY OF THE INVENTION

In view of the foregoing disadvantages inherent in the known types of illuminated drinking vessels now present in the prior art, the present invention provides an improved glow cup apparatus. As such, the general purpose of the present invention, which will be described subsequently in greater detail, is to provide a new and improved glow cup apparatus which has all the advantages of the prior art and none of the disadvantages.

To attain this, the present invention essentially comprises a first generally cylindrically shaped container being mildly compressible. The first generally cylindrically shaped container has a first outer wall communicating with a first outer bottom and a first inner wall communicating with a first inner bottom. The first outer wall and the first inner wall define a first upper edge and a first continuous wall space. The first inner bottom and the first inner bottom define a floor space. The first outer wall is extended a distance from the first outer bottom.

Also, the first outer bottom has a cylindrical recess projecting inwardly thereof. The cylindrical recess has an inner wall with a ribbed surface. The ribbed surface is sized and shaped to receive a twist off bottle cap.

A second generally cylindrically shaped container is provided. The second generally cylindrically shaped container has a second outer wall communicating with a second outer bottom. It also has a second inner wall communicating with a second inner bottom. The second outer wall has a pair of concave recesses symmetrically positioned thereabout. The second generally cylindrically shaped container is sized to be positioned within the first generally cylindrically shaped container and defines a spacing between the first and second container.

Included are a pair of ampules. Each of the ampules have a thin membrane. The pair of ampules form a first ampule and a second ampule. Each of the pair ampules contains a first chemiluminescent fluid. One of each of the pair of ampules is positioned within one of each of the pair of concave recesses of the second generally cylindrically shaped container. Each of the pair of ampules is retained within concave recesses when the second generally cylindrically shaped container is positioned within the first generally cylindrically shaped container.

Additionally, a second chemiluminescent fluid is sealed within the spacing between the first generally cylindrically shaped container and the second generally cylindrically shaped container.

An upper rim is formed about the second generally cylindrically shaped container. The upper rim has a first horizontal portion extending outwardly therefrom and a second horizontal portion spaced therefrom and extending from the upper rim. The first horizontal portion engages the upper edge of the first outer wall of the first generally cylindrically container. The first horizontal portion encloses the spacing of the first generally cylindrically shaped container and the second generally cylindrically shaped container.

Finally, the first generally cylindrically shaped container has a force applied to the a first outer wall to compress the first inner wall. The force presses the first inner wall against the pair of ampules to rupture the thin membrane. The thin membrane of the pair of ampules, when ruptured, allows the first chemiluminescent fluid to flow into the spacing and mix with the second chemiluminescent fluid to produce a chemiluminescent reaction.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved glow cup apparatus which has all the advantages of the prior art illuminated drinking vessels and none of the disadvantages.

It is another object of the present invention to provide a new and improved glow cup apparatus which may be easily and efficiently manufactured and marketed.

It is a further object of the present invention to provide a new and improved glow cup apparatus which is of a durable and reliable construction.

An even further object of the present invention is to provide a new and improved glow cup apparatus which is susceptible of a low cost of manufacture with regard to both materials and labor, and which accordingly is then susceptible of low prices of sale to the consuming public, thereby making such glow cup apparatus economically available to the buying public.

Still yet another object of the present invention is to provide a new and improved glow cup apparatus which provides in the apparatuses and methods of the prior art some of the advantages thereof, while simultaneously overcoming some of the disadvantages normally associated therewith.

Still another object of the present invention is to providing an illuminated drinking vessel and further provide a drinking vessel that can be used to open a twist off cap.

Lastly, it is an object of the present invention to provide a new and improved glow cup apparatus including a container of a material which is deformable upon the application of pressure by a user's hand. The container is formed with an open top and a closed bottom and a side wall between the top and bottom. The side wall has a cylindrical wall extending from a location adjacent to the top downwardly to a location adjacent to the bottom and radially exterior of the side wall and with a circular member to form a seal at the bottom of the outer wall to totally close the space between the side wall an the outer wall. An insert of a plastic material is located within the space with an inner surface in proximity to the outer surface of the side wall. A recess is formed along one vertical extent and between the insert and a side wall. A fracturable ampule is vertically oriented within the recess and contains a first chemiluminescent fluid. A second chemiluminescent fluid is positionable within the space and is adapted to be illuminated upon the fracturing of the ampule and contact with the first chemiluminescent fluid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a cross-sectional view of a second alternate embodiment of the present invention.

FIG. 8 is a cross-sectional of the second alternate embodiment taken along lines 8—8 of FIG. 7.

FIG. 9 is a perspective view of a third alternate embodiment of the present invention.

FIG. 10 is a top plan view of the invention of FIG. 9.

Similar reference characters refer to similar parts throughout the several views of the drawings.

DESCRIPTION OF THE PREFERRED EMBODIMENT

Figure 1:
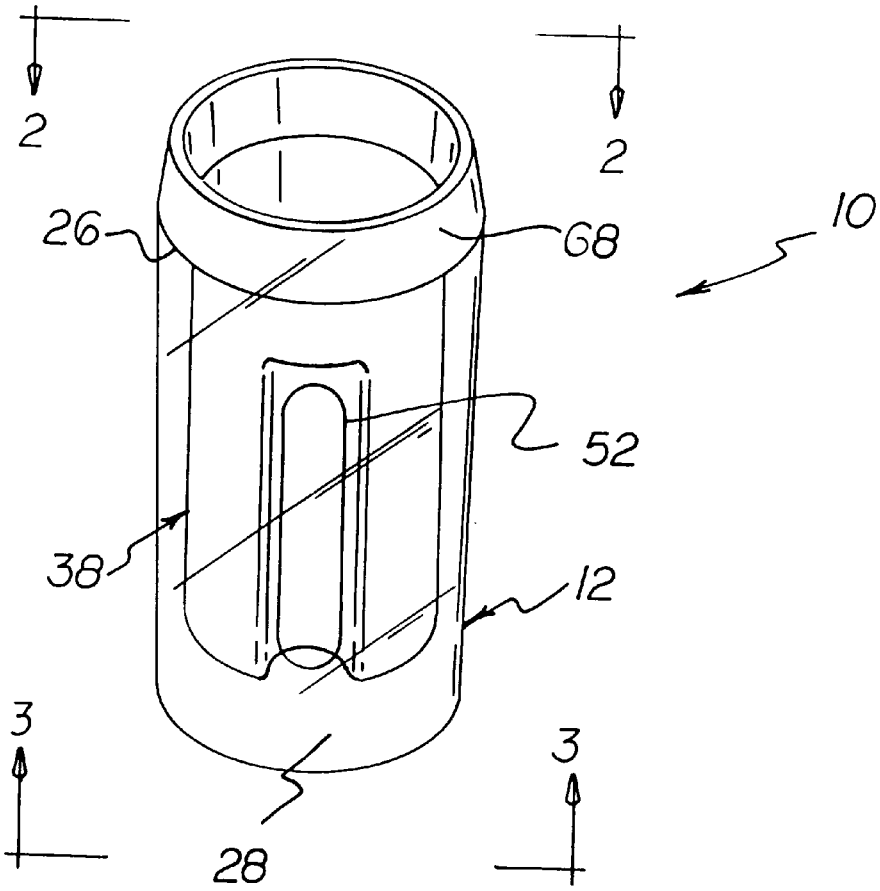
FIG. 1 is a perspective view of the preferred embodiment of the glow cup apparatus constructed in accordance with the principles of the present invention.

With reference now to the drawings, and in particular to FIG. 1 thereof, a new and improved glow cup apparatus embodying the principles and concepts of the present invention and generally designated by the reference numerals 10, 80, 110 and 150 will be described.

The present invention, the new and improved glow cup apparatus, is comprised of a plurality of components. Such components in their broadest context include a first generally cylindrically shaped container, a second generally cylindrically container, a first chemiluminescent fluid, a second chemiluminescent fluid and at one least ampule. Such components are individually configured and correlated with respect to each other so as to attain the desired objective.

Figure 4:
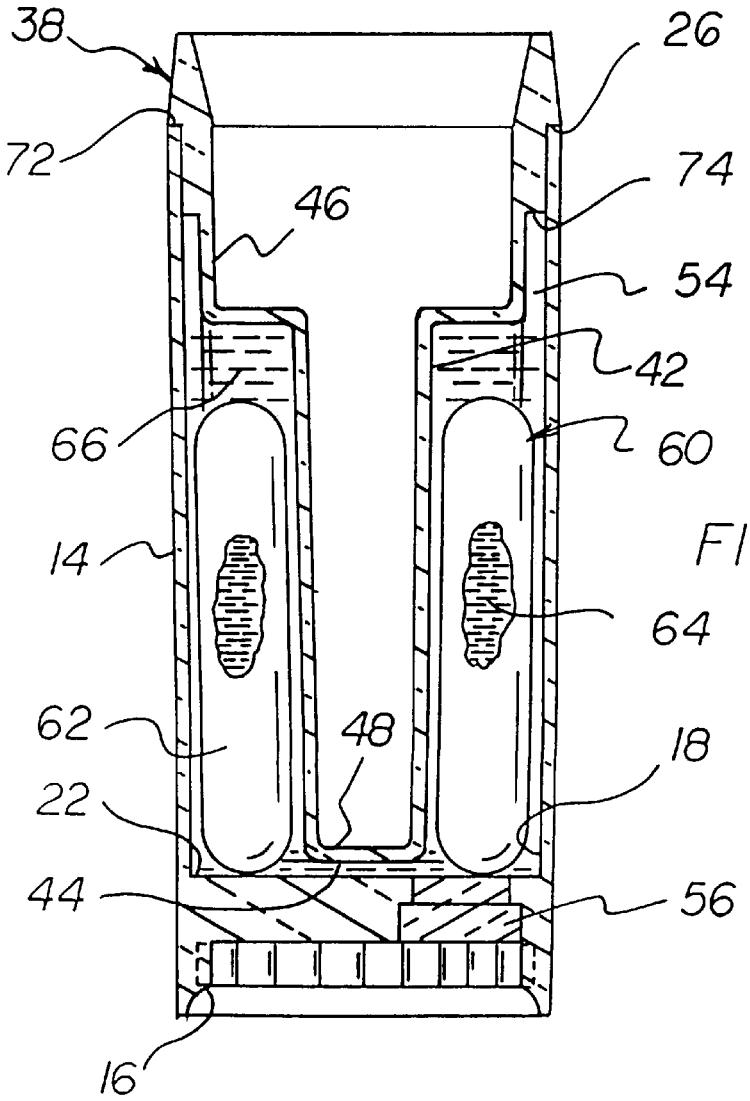
FIG. 4 is a cross-sectional view of the present invention taken along lines 4—4 of FIG. 2.

More specifically, the present invention includes a first generally cylindrically shaped container 12 being mildly compressible, as seen in FIG. 1. The first generally cylindrically shaped container has a first outer wall 14 communicating with a first outer bottom 16. The first generally cylindrically shaped container has a first inner wall communicating with a first inner bottom 22. The first inner and outer walls are illustrated in FIG. 4. The first outer wall and the first inner wall define a first upper edge 26 and a first continuous wall space 28. The first inner bottom and the first outer bottom define a floor space. The first outer wall is extended a distance from the first outer bottom.

Figure 3:
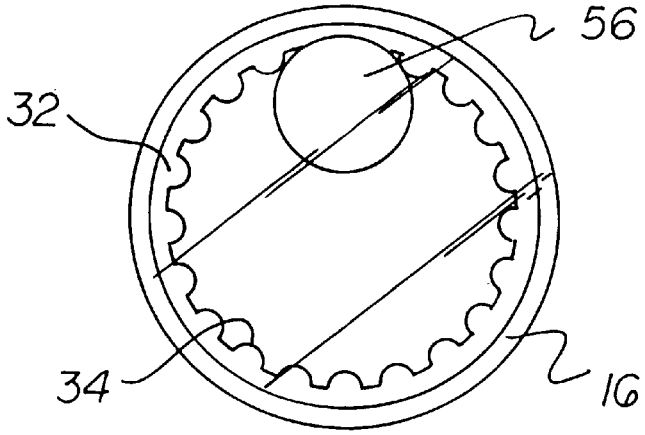
FIG. 3 is a bottom plan view of the present invention taken along lines 3—3 of FIG. 1 of the present invention.

Also, the first outer bottom has a cylindrical recess 32, as depicted in FIG. 3, and shown to project inwardly of the first outer bottom. The cylindrical recess has a ribbed inner wall 34. The ribbed inner wall is sized and shaped to receive a twist off bottle cap. The type of twist off cap found on beer bottles and soft drink bottles.

Figure 2:
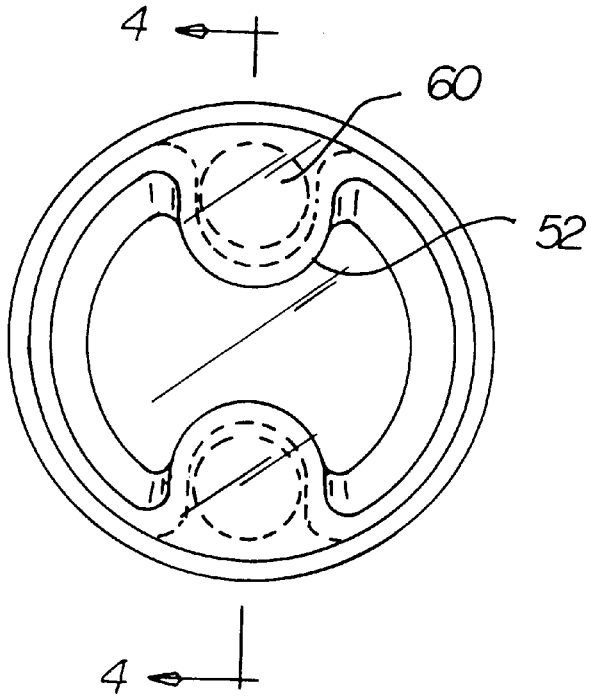
FIG. 2 is a top plan view the present invention taken along lines 2—2 of FIG. 1.

A second generally cylindrically shaped container 38 is provided. The second generally cylindrically shaped container has a second outer wall 42 communicating with a second outer bottom 44. It also has a second inner 46 wall communicating with a second inner bottom 48. As seen in FIG. 2, the second outer wall has a pair of concave recesses 52. The pair of concave recesses are symmetrically positioned one from the other about the second outer wall. The second generally cylindrically shaped container is sized to be positioned within the first generally cylindrically shaped container and defines a spacing 54 between the first and second container. Access to the spacing may only be obtained through the cylindrical recess at the first outer bottom, as shown in FIG. 4. FIGS. 3 and 4 depict a removable plug 56. The plug seals the second chemiluminescent fluid within the spacing 54.

Included are a pair of ampules 60. Each of the ampules have a thin membrane 62. The pair of ampules form a first ampule and a second ampule. Each of the pair ampules contains a first chemiluminescent fluid 64.

The first chemiluminescent fluid is an oxalent. The oxalate components used in the present invention are standard in the chemiluminescent industry. Such as the oxalate ester present as a solution in the selected propylene glycol dihydrocarbyl ether solvent. The oxalent esters employed in the present invention are well known in the prior art of U.S. Pat. Nos. 5,171,081, 5,218,367, 5,597,517, 5,705,103 and 5,597,517. The oxalent may include the solvent and the fluorescent or just the solvent. Any one of the prior arts listed are capable of providing the desired oxalent for the present invention.

One of each of the pair of ampules is positioned within one of each of the pair of concave recesses 52 of the second generally cylindrically shaped container 38. Each of the pair of ampules is retained within concave recesses when the second generally cylindrically shaped container is positioned within the first generally cylindrically shaped container.

Additionally, a second chemiluminescent fluid 66 is sealed within the spacing between the first generally cylindrically shaped container and the second generally cylindrically shaped container. The second chemiluminescent fluid is the activator. The activator capable of providing the desired chemiluminescent for the invention when combined with the oxalent in the present invention is well known in the prior art of U.S. Pat. Nos. 5,171,081, 5,218,367, 5,597,517, 5,705,103 and 5,597,517. The activator may include the fluorescent or the catalyst. Any one of the prior arts listed are capable of providing the desired activator for the present invention.

The second chemiluminescent fluid is placed within the spacing after the first and second generally cylindrically shaped containers are spin welded together. This coupling is done after the ampules are in position. The second chemiluminescent fluid is placed in the spacing by way of the cylindrical recess. Once the second chemiluminescent fluid is in the spacing, the plug 56 is put in position and permanently seals the second fluid in the spacing.

An upper rim 68 is formed about the second generally cylindrically shaped container. The upper rim has a first horizontal portion 72 extending outwardly therefrom and a second horizontal portion 74 spaced therefrom and extending from the upper rim. FIG. 4 shows the first horizontal portion engaging the upper edge of the first outer wall of the first generally cylindrically container. The first horizontal portion encloses the spacing of the first generally cylindrically shaped container and the second generally cylindrically shaped container.

Finally, the first generally cylindrically shaped container has a force applied to the a first outer wall to compress the first inner wall. The force presses the first inner wall against the pair of ampules to rupture the thin membrane. The thin membrane of the pair of ampules, when ruptured, allows the first chemiluminescent fluid to flow into the spacing and mix with the second chemiluminescent fluid to produce a chemiluminescent reaction.

Figure 5:
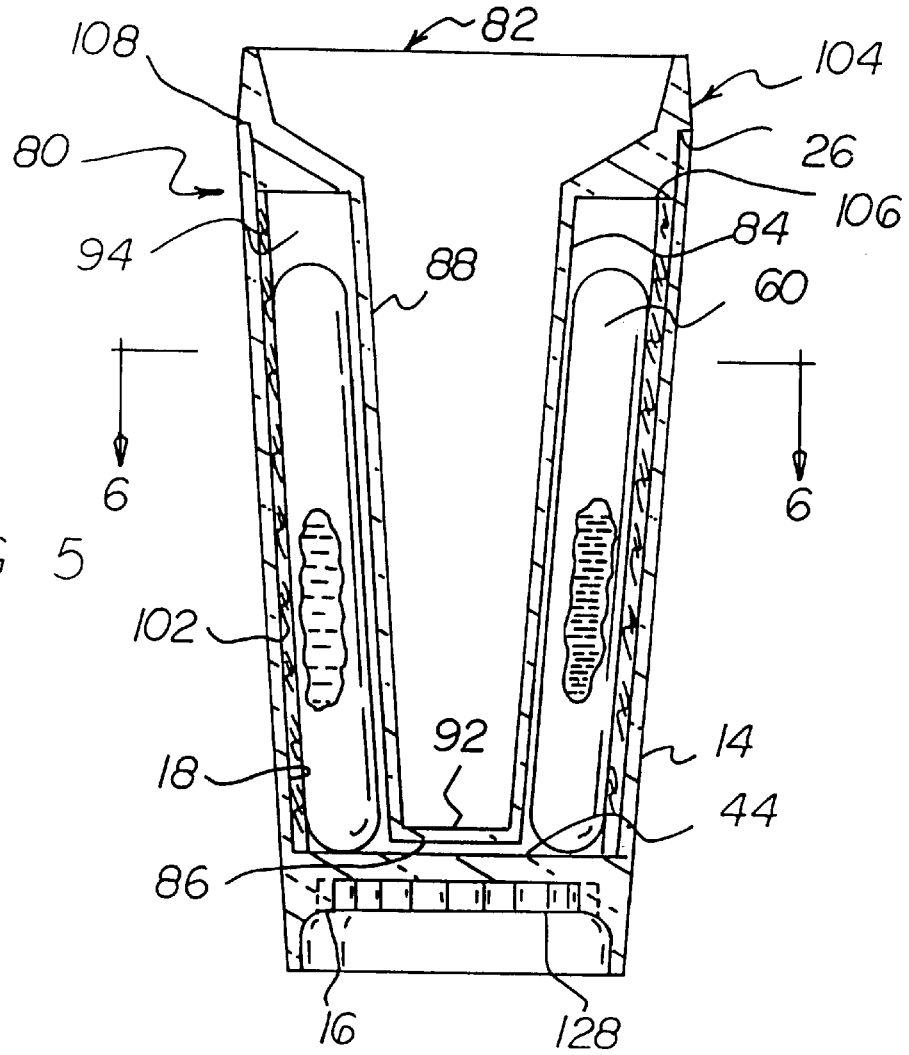
FIG. 5 is a cross-sectional view of a first alternate embodiment of the present invention.

Furthermore, the present invention may come with three alternative container forms. The first alternate embodiment 80 is shown in FIG. 5. The first alternate embodiment has a first generally cylindrically shaped container 12 with a structure like FIG. 4. The difference between the embodiments of FIG. 4 and FIG. 5 are found in the second generally cylindrically shaped container of each. The second generally cylindrically shaped container 82 of the first alternate embodiment has a second outer wall 84 communicating with a second outer bottom 86. Also, it includes a second inner wall 88 communicating with a second inner bottom 92. The second generally cylindrically shaped container 12 is sized for positioning within the first generally cylindrically shaped container and defining a spacing 94.

Included are a pair of ampules 60 which are identical in form to the ampules of FIG. 4. The ampules of first alternate embodiment of FIG. 5 may be more elongated. Each is positioned within the spacing and has a first chemiluminescent fluid.

Figure 6:
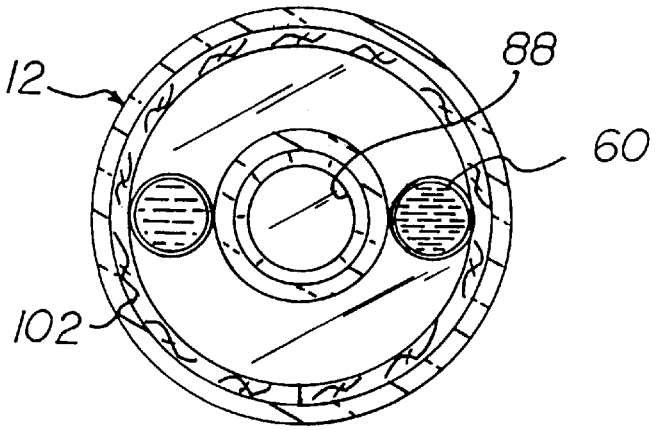
FIG. 6 is a cross-sectional of the first alternate embodiment taken along lines 6—6 of FIG. 5.

Additionally, a felt like material 102 is impregnated with a second chemiluminescent fluid. As shown in FIGS. 5 and 6, the felt like material is attached to the inner wall of the first generally cylindrically shaped container.

A peripheral rim 104 is formed about the second generally cylindrically shaped container. The peripheral rim is formed by a first horizontal rim 106 extending outwardly therefrom and a second horizontal rim 108 extending above the first horizontal rim. The second horizontal rim engages an upper edge 26 of the first outer wall of the first generally cylindrically container for enclosing the spacing of the first generally cylindrically shaped container and the second generally cylindrically shaped container.

Lastly, in the first alternate embodiment, the first generally cylindrically shaped container has a force applied to the first outer wall for compressing the first inner wall against the pair of ampules to rupture the thin membrane. The thin membrane of the pair of ampules, when ruptured, allows the first chemiluminescent fluid to be absorbed into the felt to produce a chemiluminescent reaction.

The second alternate embodiment 110 has properties similar to the embodiments discussed above. This embodiment has a generally cylindrically shaped container 112. The generally cylindrically shaped container has a first outer wall 114 communicating with an outer bottom 116 and a first inner wall 118 communicating with a first inner bottom 122. The first outer wall is extended a distance from the first outer bottom. The first outer wall has a generally concave recess 126, as seen in FIG. 8. The outer bottom has a cylindrical recess 128 with a ribbed inner wall 132 that is sized and shaped to receive a twist off bottle cap.

Included is a convex cover 136. The convex cover is mildly compressible. The convex cover has a second outer wall 138 and a second inner wall 142 communicating with the first inner bottom 122. The convex cover is sized for positioning over the concave recess of the generally cylindrically shaped container to define a spacing 144 therebetween.

At least one ampule 60 is positioned within the concave recess of the generally cylindrically shaped container. The ampule has a first chemiluminescent fluid 64. The first chemiluminescent fluid is the same for each ampule. As best illustrated in FIG. 7, a second chemiluminescent fluid 66 is sealed within the spacing between the generally cylindrically shaped container and the cover.

Lastly, the convex cover has a force applied to the a first outer wall for compressing the first inner wall against the ampule to rupture the thin membrane. The thin membrane of the ampule being ruptured allows the first chemiluminescent fluid to flow into the spacing and mix with the second chemiluminescent fluid to produce a chemiluminescent reaction.

Figure 11:
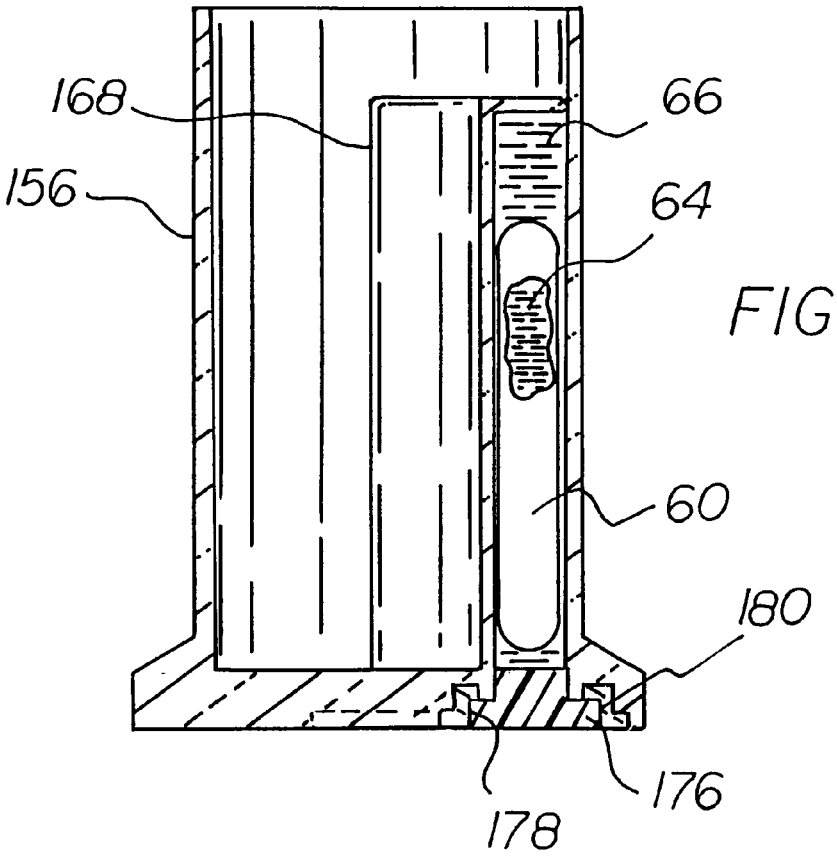
FIG. 11 is a cross-sectional view taken along lines 11—11 of FIG. 10.

The third alternate embodiment 150 comes in a cup form 152 and a glass form 154. It should be understood that the properties of the glass are identical to the cup. The properties of the third alternate embodiment are similar to the embodiments discussed above. This embodiment has a generally cylindrically shaped container 156 as shown in FIG. 11. The generally cylindrically shaped container has a first outer wall 160 communicating with a base portion 162, as seen in FIG. 9. Also, the container has a first inner wall 164 communicating with a first inner bottom 166, as shown in FIG. 10. The inner wall has a semi-concave section 168 for defining an interior spaced 172 adjacent the first outer wall. The interior space exiting into the base portion for the creation of an entry way 174.

As shown in FIGS. 9 an ampule 60 is positioned within the interior space 172. The ampule having a first chemiluminescent fluid 64. The first chemiluminescent fluid is the same for each ampule.

As best illustrated in FIG. 11, a second chemiluminescent fluid 66 positioned within the interior space 172. The second chemiluminescent fluid is the same for each embodiment of the present invention and is set forth above.

Figure 12:
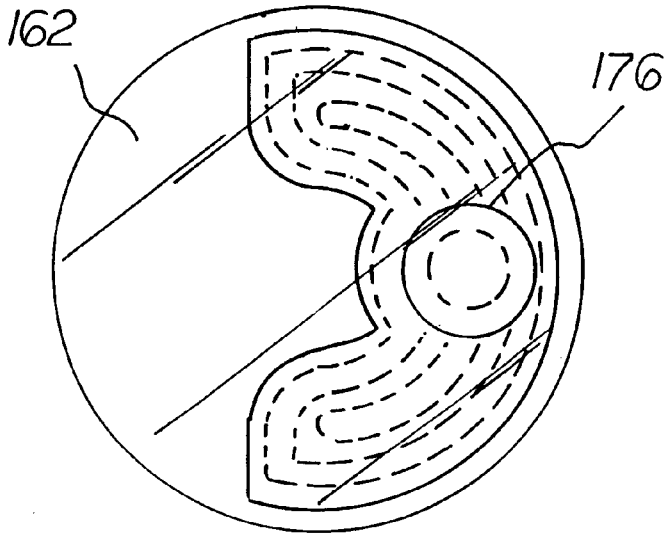
FIG. 12 is a bottom view of the embodiment of FIG. 9.
Figure 13:
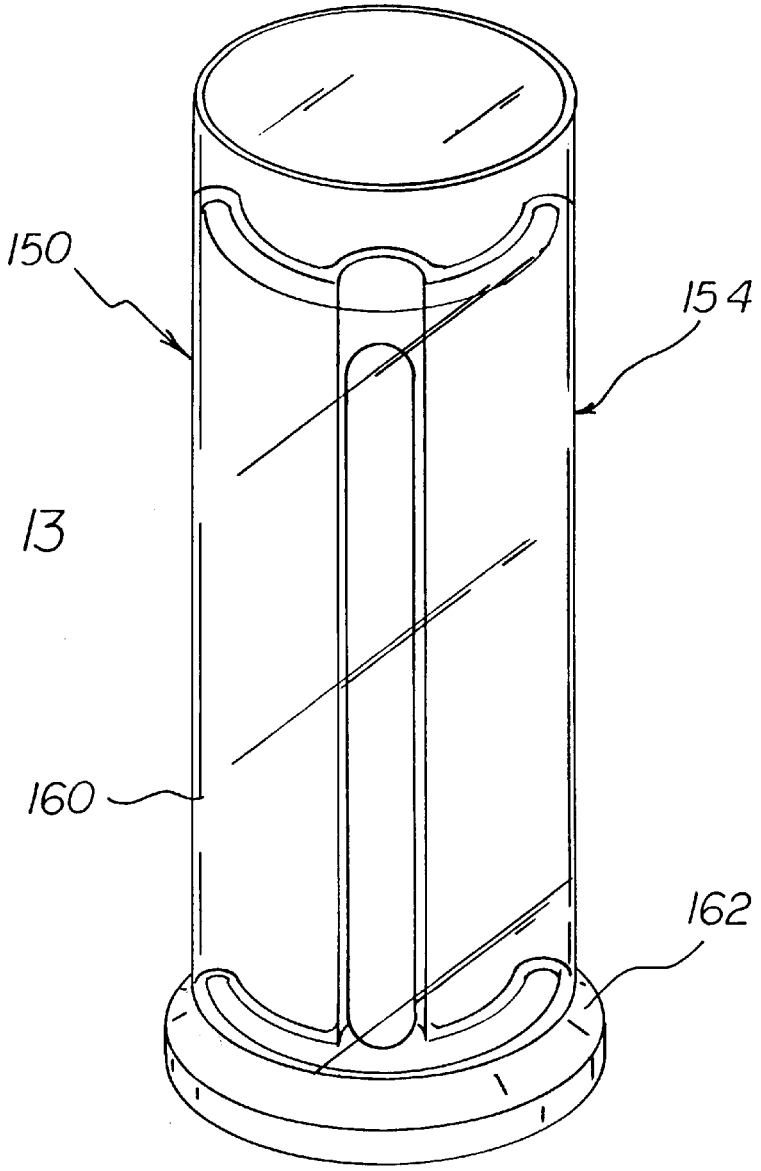
FIG. 13 is a prespective view of an enlarged version of the third alternate embodiment of the present invention.
Figure 14:
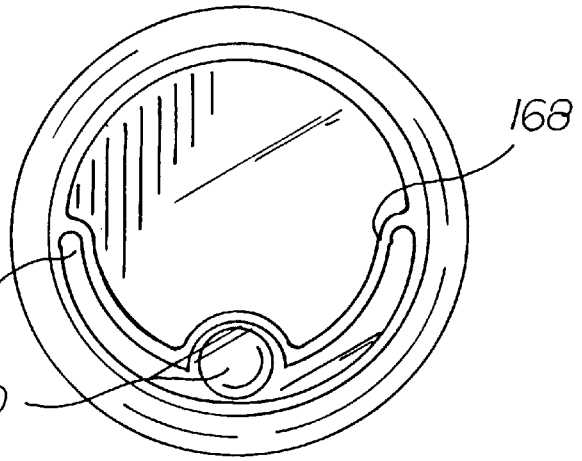
FIG. 14 is a top view of the embodiment of FIG. 13.
Figure 15:
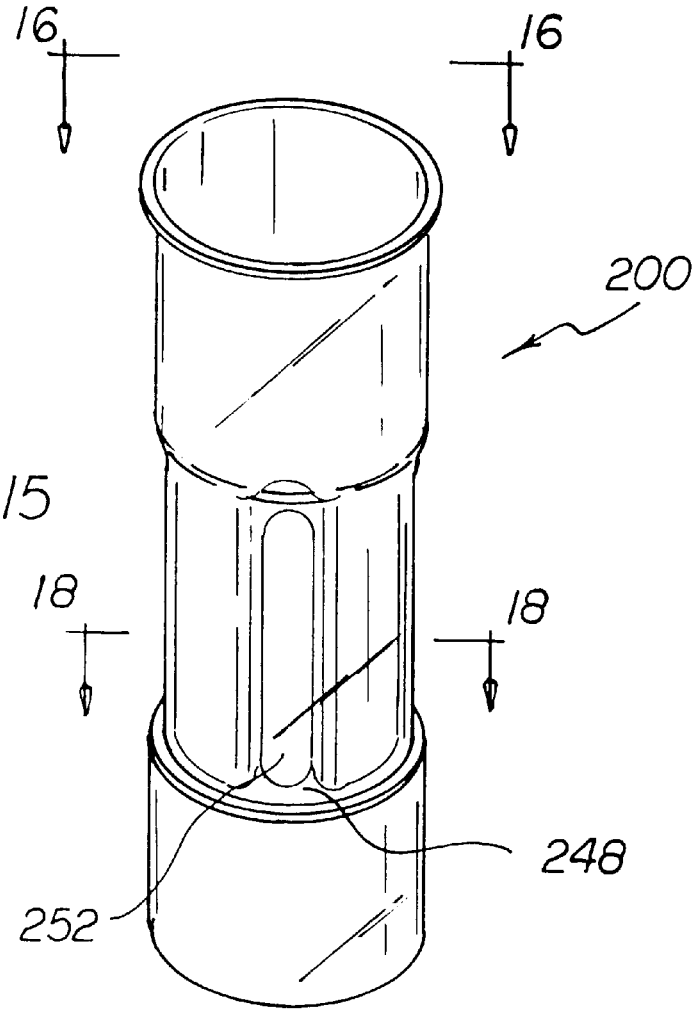
FIG. 15 is a perspective view of an alternate embodiment of the invention.
Figure 16:
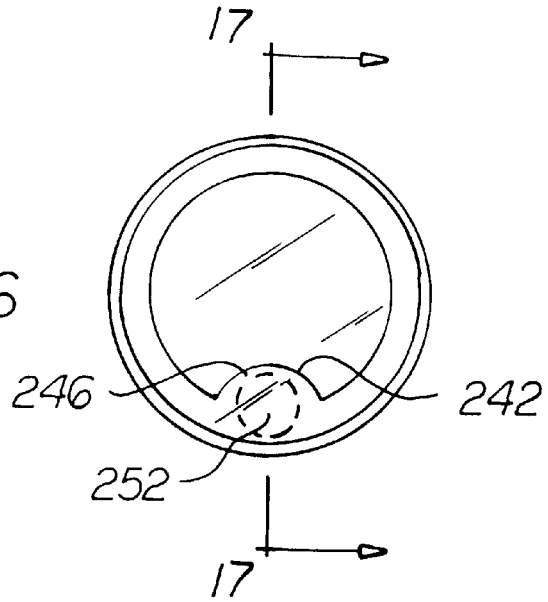
FIG. 16 is a top view taken along line 16—16 of FIG. 15.
Figure 17:
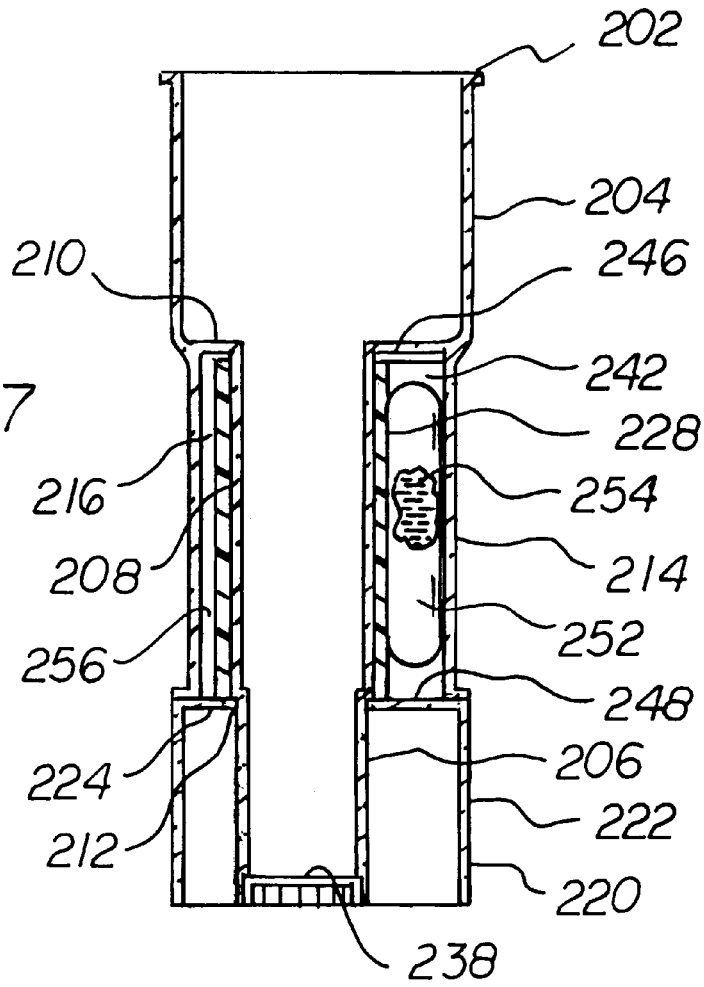
FIG. 17 is a cross sectional view taken along line 17—17 of FIG. 16.
Figure 18:
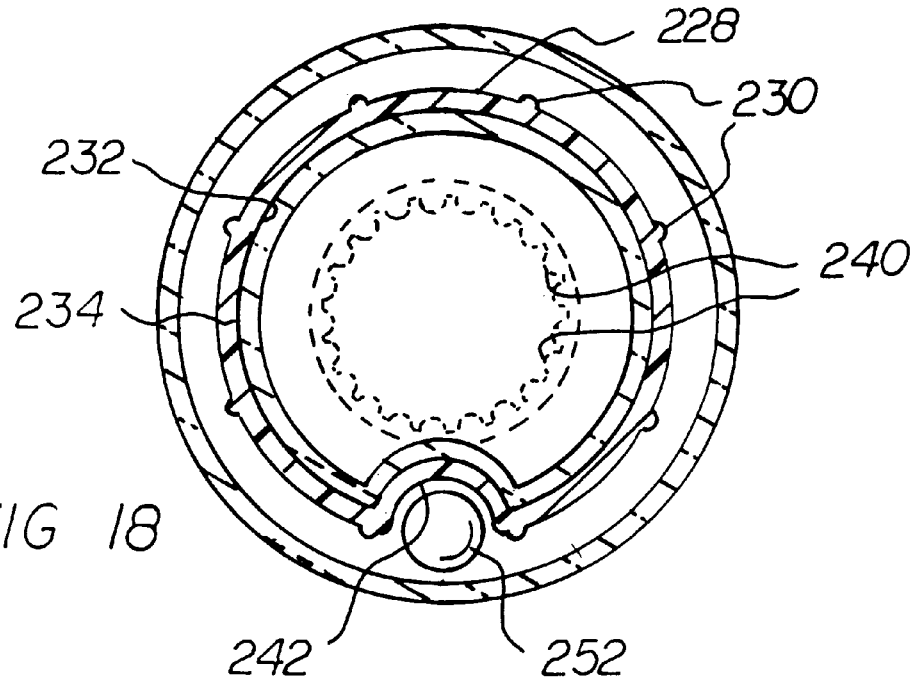
FIG. 18 is a cross sectional view taken along 18—18 of FIG. 15.

Finally, a bottom cover plate 176 is provided. As shown in FIGS. 11 and 12 the bottom cover plate has a tongue 178 and groove 180 periphery for engaging a bottom opening of the base portion. The bottom cover sealing the ampule and the second chemiluminescent fluid within the interior space of the generally cylindrically shaped container. FIG. 13 and FIG. 14 are larger versions of the cup of FIG. 9.

A simplified embodiment is shown in FIGS. 15 through 18. In such embodiment, a glow cup system 200 has illumination capabilities over at least a portion of the cup periphery during operation and use. First provided is a container 202. The container is formed of a translucent plastic material with limited flexibility to render it deformable upon the application of pressure by a user's hand similar to the prior embodiments. The container is formed in a generally cylindrical configuration. The container has an upper generally cylindrical section 204 of an enlarged diameter and a lower generally cylindrical section 206 of a reduced diameter. The container also has an intermediate section 208 between the upper section and lower section. The intermediate section is formed in a generally cylindrical configuration with an intermediate diameter. At least the lower and intermediate sections are formed to have a frustroconical taper wider at the top than at the bottom to facilitate removal from a mold during fabrication.

The container is formed with a generally disc shaped generally horizontal upper shoulder 210 between the upper and intermediate sections. A disc shaped generally horizontal lower shoulder 212 is provided between the intermediate and lower sections. The intermediate section also has a cylindrical outer wall 214 extending downwardly from the upper shoulder radially exterior of the intermediate section to form an enclosable generally cylindrical space 216. The portion of the container between the space and the interior of the container is continuous and without a seam to preclude the flow of fluid from the space to the container for user safety for complying with government safety regulations.

Next provided in this embodiment is a lower inverted cup 220. The cup has an exterior generally cylindrical face 222 surrounding the lower section of the container. The cup has an exterior diameter generally equal to the exterior diameter of the outer wall. The cup also has a generally disc shaped horizontal plate 224 contacting the lower edge of the outer wall and the lower shoulder. The horizontal plate is sealed with respect to the lower edge of the outer wall and the lower shoulder to effect the sealing of the space.

Next provided is a generally rigid cylindrical insert 228. The insert is formed of a white plastic material. Vertical ribs 230 extend outwardly from the insert. The inner surface 232 is preferably in contact with the outer surface 234 of the intermediate section.

An inverted stopper 238 is secured within the lower extent of the lower section and forms a bottom for the container to allow the receipt and support of a fluid within the container. The lower central extent of the stopper has inwardly facing teeth 240 which function as energy directors. Such teeth are sized to fit over a bottle cap whereby the lower portion of the glow cup system may function as a bottle opener.

A vertically disposed semi-cylindrical recess 242 is formed within the insert and intermediate and lower sections along one vertical region. The recess is sealed above and below by inwardly facing projections 246, 248 on the upper shoulder and the plate.

A fracturable ampule 252 is next provided. The ampule is vertically oriented within the recess. A first chemiluminescent fluid 254 is provided within the ampule. The fluid is thereby dispensed into the space upon the fracture of the ampule when the outer wall is squeezed by a user.

Finally, a second chemiluminescent fluid 256 is positioned within the space. The second fluid is adapted to be illuminated upon the fracturing of the ampule and contact with the first chemiluminescent fluid.

Figure 19:
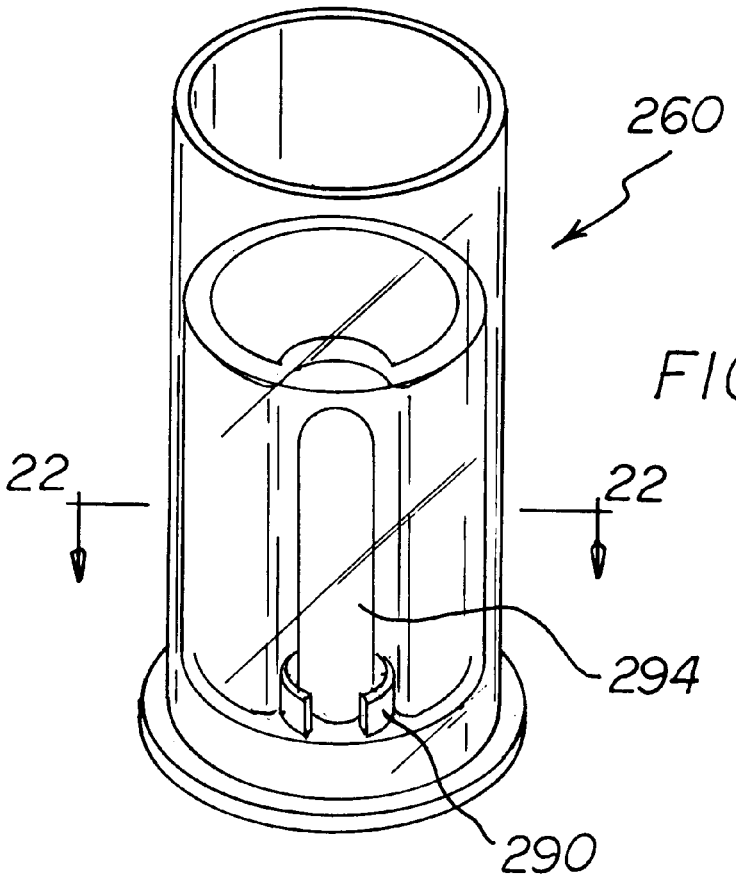
FIG. 19 is a cross sectional view of yet another alternate embodiment of the invention.
Figure 20:
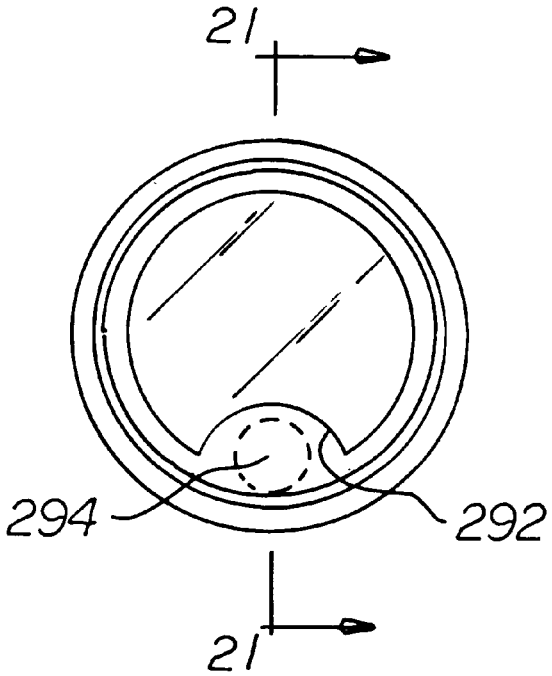
FIG. 20 is a cross sectional view taken along line 20—20 of FIG. 19.
Figure 21:
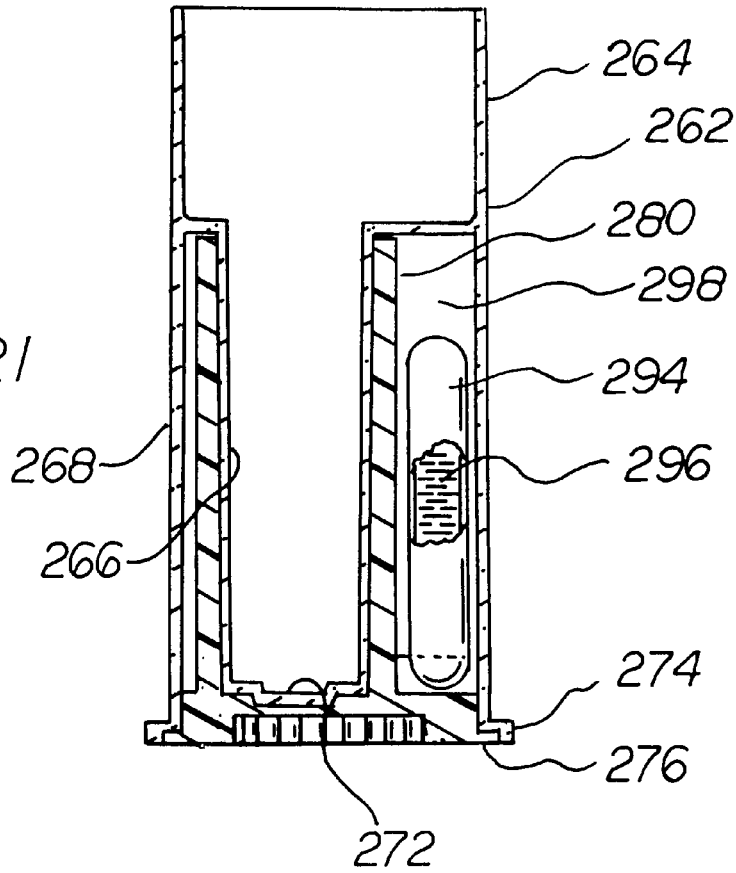
FIG. 21 is a cross sectional view similar to FIG. 17 but to an alternate embodiment.
Figure 22:
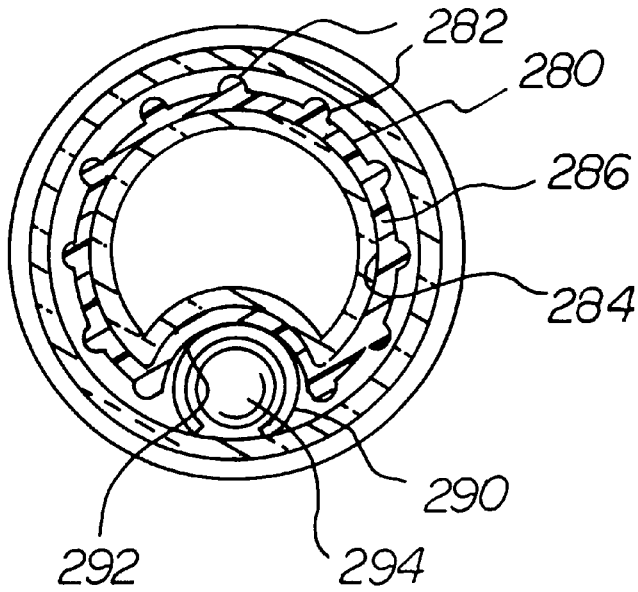
FIG. 22 is a cross sectional view similar to FIG. 18 but to the FIG. 21 embodiment.

The final embodiment is shown in FIGS. 19 and 20. Such embodiment is similar to that of FIGS. 15 through 18 but, preferably, of a smaller size. The glow cup 260 of this embodiment has a container 262. Such container is formed in a generally cylindrical configuration. The container has an upper, generally cylindrical section 264 of an enlarged diameter and a lower generally cylindrical section 266 of a reduced diameter. Also included is a generally cylindrical outer wall 268 formed as a cylindrical extension of the upper section. A generally cylindrical space is thereby formed between the lower section and the outer wall.

Unlike the prior embodiment, this embodiment has a bottom 272 of the lower section molded integrally with the lower ends of the lower side wall to totally seal the entire drink receiving container except at the open upper top. In addition, the lowermost end of the outer wall extends lower than the lowermost extent of the lower section. Further, an outwardly then downwardly extending flange 274 is integrally formed with the outer wall. This is to receive a sealing disc 276 adapted to be received within the flange to thereby totally seal the space between the lower section and the outer wall.

As in the prior embodiment, there is next provided a generally rigid cylindrical insert 280. The insert is formed of a colored plastic material, preferably white. Vertical ribs 282 extend outwardly from the insert. The inner surface 284 is preferably in proximity to the outer surface 286 of the lower section 288. The sealing disk and the insert are preferably molded together as a one-piece unit for ease of fabrication and assembly. Also molded together therewith is a C-shaped clip 290 for supporting the ampule. This, once again, is for ease of assembly.

A vertically disposed semi-cylindrical recess 292 is formed within the insert and lower section along one vertical region.

A fracturable ampule 294 is next provided. The ampule is vertically oriented within the recess. A first chemiluminescent fluid 296 is provide within the ampule. The fluid is thereby dispensed into the space upon the fracture of the ample when the outer wall is squeezed by a user. A second chemiluminescent fluid 298 is positioned within the space. The second fluid is adapted to be illuminated upon the fracturing of the ampule in contact with the first chemiluminescent fluid.

The preferred material for the cup is a plastic such as polypropylene, clarified polypropylene, polyethylene or polyethylene terepthalate (PET). The preferred material for the insert is the same as that for the cup, but preferably colored, such as white.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved glow cup apparatus comprising, in combination:

a first generally cylindrically shaped container being mildly compressible, the first generally cylindrically shaped container having a first outer wall communicating with a first outer bottom and a first inner wall communicating with a first inner bottom, the first outer wall and the first inner wall defining a first upper edge and a first continuous wall space, the first inner bottom and the first inner bottom defining a floor space therebetween, the first outer wall being extended a distance from the first outer bottom;

the first outer bottom having a cylindrical recess projecting inwardly thereof, the cylindrical recess having an ribbed inner wall, the ribbed inner wall being sized and shaped to receive a twist off bottle cap;

a second generally cylindrically shaped container having a second outer wall communicating with a second outer bottom and a second inner wall communicating with a second inner bottom, the second outer wall having a pair of concave recesses symmetrically positioned thereabout, the second generally cylindrically shaped container being sized for positioning within the first generally cylindrically shaped container and defining a spacing therebetween;

a pair of ampules each having a thin membrane, the pair of ampules forming a first ampule and a second ampule, each of the pair ampules having a first chemiluminescent fluid therein, one of each of the pair of ampules being positioned within one of each of the pair of concave recesses of the second generally cylindrically shaped container, each of the pair of ampules being retained within concave recesses when the second generally cylindrically shaped container being positioned within the first generally cylindrically shaped container;

a second chemiluminescent fluid being sealed within the spacing between the first generally cylindrically shaped container and the second generally cylindrically shaped container;

an upper rim about the second generally cylindrically shaped container, the upper rim having a first horizontal portion extending outwardly therefrom and a second horizontal portion spaced therefrom and extending from the upper rim, the first horizontal portion engaging the upper edge of the first outer wall of the first generally cylindrically container for enclosing the spacing of the first generally cylindrically shaped container and the second generally cylindrically shaped container; and the first generally cylindrically shaped container having a force applied to the a first outer wall for compressing the first inner wall against the pair of ampules to rupture the thin membrane, the thin membrane of the pair of ampules being ruptured allows the first chemiluminescent fluid to flow into the spacing and mix with the second chemiluminescent fluid to produce a chemiluminescent reaction.

2. A glow cup apparatus comprising:

a first generally cylindrically shaped container, the first generally cylindrically shaped container having a first outer wall communicating with a first outer bottom and a first inner wall communicating with a first inner bottom, the first outer wall being extended a distance from the first outer bottom and forming a cylindrical recess, the cylindrical recess projecting inwardly thereof, the cylindrical recess having a ribbed inner wall being sized and shaped to receive a twist off bottle cap;

a second generally cylindrically shaped container having a second outer wall communicating with a second outer bottom and a second inner wall communicating with a second inner bottom, the second generally cylindrically shaped container being sized for positioning within the first generally cylindrically shaped container and defining a spacing therebetween;

a pair of ampules each having a thin membrane with one each positioned within the spacing, each of the pair ampules having a first chemiluminescent fluid therein;

a felt like material impregnated with a second chemiluminescent fluid being attached to the inner wall of the first generally cylindrically shaped container; and a peripheral rim about the second generally cylindrically shaped container the peripheral rim being formed by a first horizontal rim extending outwardly therefrom and a second horizontal rim extending form the first horizontal rim, the second horizontal rim engaging an upper edge of the first outer wall of the first generally cylindrically container for enclosing the spacing of the first generally cylindrically shaped container and the second generally cylindrically shaped container.

3. The glow cup apparatus as set forth in claim 2, wherein the first generally cylindrically shaped container being mildly compressible.

4. The glow cup apparatus as set forth in claim 2, wherein the first outer wall and the first inner wall defining the first upper edge and a first continuous wall space, and the first inner bottom and the first inner bottom defining a floor space therebetween.

5. The glow cup apparatus as set forth in claim 2, wherein the pair of ampules forming a first ampule, a second ampule and the pair of ampules being retained within spacing when the second generally cylindrically shaped container being positioned within the first generally cylindrically shaped container.

6. The glow cup apparatus as set forth in claim 2, wherein the first generally cylindrically shaped container having a force applied to the first outer wall for compressing the first inner wall against the pair of ampules to rupture the thin membrane, and the thin membrane of the pair of ampules being ruptured allows the first chemiluminescent fluid to be absorbed into the felt to produce a chemiluminescent reaction.

7. A glow cup apparatus comprising:

a generally cylindrically shaped container having a first outer wall communicating with an outer bottom and a first inner wall communicating with a first inner bottom, the first outer wall being extended a distance from the first outer bottom, the first outer wall having a generally concave recess therein;

a convex cover being mildly compressible and having a second outer wall and a second inner wall communicating with the first inner bottom, the convex cover being sized for positioning over the concave recess of the generally cylindrically shaped container and defining a spacing therebetween;

an ampules being positioned within the concave recess of the generally cylindrically shaped container, the ampule having a first chemiluminescent fluid therein, a second chemiluminescent fluid being sealed within the spacing between the generally cylindrically shaped container and the cover; and the convex cover having a force applied to the a first outer wall for compressing the first inner wall against the ampule to rupture the thin membrane, the thin membrane of the ampule being ruptured allows the first chemiluminescent fluid to flow into the spacing and mix with the second chemiluminescent fluid to produce a chemiluminescent reaction.

8. The glow cup apparatus as set forth in claim 7, wherein the first outer wall and the first inner wall defining a first continuous wall space, and the first inner bottom and the first inner bottom defining a floor space therebetween.

9. The glow cup apparatus as set forth in claim 7, wherein the first outer bottom having a cylindrical recess projecting inwardly thereof, and the cylindrical recess having a ribbed inner wall being sized and shaped to receive a twist off bottle cap.

10. The glow cup apparatus as set forth in claim 7, wherein the ampule having a thin membrane, and the ampule being retained within concave recesses when the cover being positioned over the concave recess of the generally cylindrically shaped container.

11. A glow cup apparatus comprising:

a generally cylindrically shaped container having a first outer wall communicating with a base portion and a first inner wall communicating with a first inner bottom, the inner wall having a semi-concave section for defining an interior spaced adjacent the first outer wall, the interior space exiting into the base portion for the creation of an entry way;

an ampule being positioned within the interior space, the ampule having a first chemiluminescent fluid therein;

a second chemiluminescent fluid positioned within the interior space;

a bottom cover plate having a tongue and groove periphery for engaging a bottom opening of the base portion, the bottom cover sealing the ampule and the second chemiluminescent fluid within the interior space of the generally cylindrically shaped container.

12. A new and improved glow cup system with illumination capabilities over the cup periphery during operation and use comprising, in combination:

a container of a translucent plastic material with limited flexibility to render it deformable upon the application of pressure by a user's hand, the container being formed in a generally cylindrical configuration with an upper generally cylindrical section of an enlarged diameter and a lower generally cylindrical section of a reduced diameter and an intermediate section therebetween in a generally cylindrical configuration with an intermediate diameter, the container being formed with a generally disc shaped generally horizontal upper shoulder between the upper and intermediate sections and a disc shaped generally horizontal lower shoulder between the intermediate and lower sections, the intermediate section also having a cylindrical outer wall extending downwardly from the upper shoulder radially exterior of the intermediate section to form an enclosable generally cylindrical space therebetween, the portion of the container between the space and the interior of the container being continuous and without a seam to thereby preclude the flow of fluid therebetween;

a lower inverted cup with an exterior generally cylindrical face surrounding the lower section of the container and having an exterior diameter generally equal to the exterior diameter of the outer wall and having a generally disc shaped horizontal plate contacting the lower edge of the outer wall and the lower shoulder and sealed with respect thereto to effect the sealing of the space;

a generally rigid cylindrical insert of a white plastic material with vertical ribs extending outwardly therefrom with an inner surface in contact with the outer surface of the intermediate section;

an inverted stopper secured within the lower extent of the lower section for forming a bottom for the container to allow the receipt and support of a fluid within the container;

a vertically disposed semi-cylindrical recess formed within the insert and intermediate and lower sections along one vertical region thereof, the recess being sealed above and below by inwardly facing projections on the upper shoulder and the plate;

a fracturable ampule vertically oriented within the recess with a first chemiluminescent fluid therein for being dispensed into the space upon the fracture of the ampule by the squeezing of the outer wall by a user; and a second chemiluminescent fluid positioned within the space and adapted to be illuminated upon the fracturing of the ampule and contact with the first chemiluminescent fluid.

13. A glow cup with illumination capabilities comprising:

a container of a material which is deformable upon the application of pressure by a user's hand, the container being formed with an open top and a closed bottom and a side wall therebetween, the side wall also having a cylindrical outer wall extending from a location adjacent to the top downwardly to a location adjacent to the bottom and radially exterior of the side wall and with a circular member to form a seal at the bottom of the outer wall to thereby totally close the space between the side wall and the outer wall;

an insert of a plastic material located within the space with an inner surface in proximity to the outer surface of the side wall;

a recess formed between the insert and side wall along one vertical extent thereof;

a fracturable ampule vertically oriented within the recess with a first chemiluminescent fluid therein; and a second chemiluminescent fluid positionable within the space and adapted to be illuminated upon the fracturing of the ampule and contact with the first chemiluminescent fluid.

14. The glow cup as set forth in claim 13 wherein the container includes an upper section of an enlarged diameter, a lower section of a reduced diameter and an intermediate section of an intermediate diameter with the outer wall being laterally spaced form the intermediate section.

15. The glow cup as set forth in claim 13 wherein the container includes an upper section of an enlarged diameter and a lower section of a reduced diameter and the outer wall is laterally spaced from the lower section.

16. The glow cup as set forth in claim 13 and further including a recess in the bottom of the cup with inwardly extending teeth for functioning as a bottle cap opener.

* * * * *